US005842695A

United States Patent [19]

McVeigh

[11] Patent Number: 5,842,695

[45] Date of Patent: Dec. 1, 1998

[54] LARGE OR FLIMSY SHEETS STACKING SYSTEM FOR DISK TYPE INVERTER-STACKER

[75] Inventor: Daniel J. McVeigh, Webster, N.Y.

[73] Assignee: Xerox Corporation, Stamford, Conn.

[21] Appl. No.: 893,754

[22] Filed: Jul. 11, 1997

[51] Int. Cl.[6] ..... B65H 29/22

[52] U.S. Cl. ..... 271/187; 271/186; 271/185

[58] Field of Search ..... 270/60; 271/187, 271/186, 185, 65

[56] References Cited

U.S. PATENT DOCUMENTS

| | | | |
|---|---|---|---|
| 4,469,319 | 9/1984 | Robb et al. | 271/3.1 |
| 4,925,179 | 5/1990 | Breton et al. | 271/187 |
| 5,261,655 | 11/1993 | Keller et al. | 271/187 |
| 5,409,202 | 4/1995 | Naramore et al. | 270/53 |

OTHER PUBLICATIONS

Jenkins, W.M. "Sheet Flip Enhancer," IBM Technical Disclosure Bulletin Vol. 23, No. 7A. pp. 2635–2636, Dec. 1980.

*Primary Examiner*—William E. Terrell
*Assistant Examiner*—Patrick Mackey

[57] ABSTRACT

In a disk-type inverter-stacker system with plural rotatable fingers extending radially from an axis or rotation for sequentially inverting and stacking onto a stacking tray the printed sheets outputted by a reproduction apparatus, by temporarily retaining at least the leading portion of the sheet in sheet transporting slots defined by inside surfaces of the rotatable fingers, a fixed position sheet corrugating member is spaced from but interdigitated with the rotatable fingers, extending slightly radially beyond the inside surfaces of the fingers to slightly corrugate the leading portion of said sheet while it is in the finger-defined slots to provide improved inverting and stacking of sheets exceeding the length of the slots. Preferably, there is a fixed semi-cylindrical baffle radially inside of said rotatable fingers, and the sheet corrugating member is an arcuate narrow finger-like member mounted to and extending partially around this arcuate baffle between two of the fingers, causing sheets exceeding the length of the slots to form a loop extending above the inverter-stacker system.

4 Claims, 5 Drawing Sheets

LARGE OR FLIMSY SHEETS STACKING SYSTEM FOR DISK TYPE INVERTER-STACKER

Figure 1:
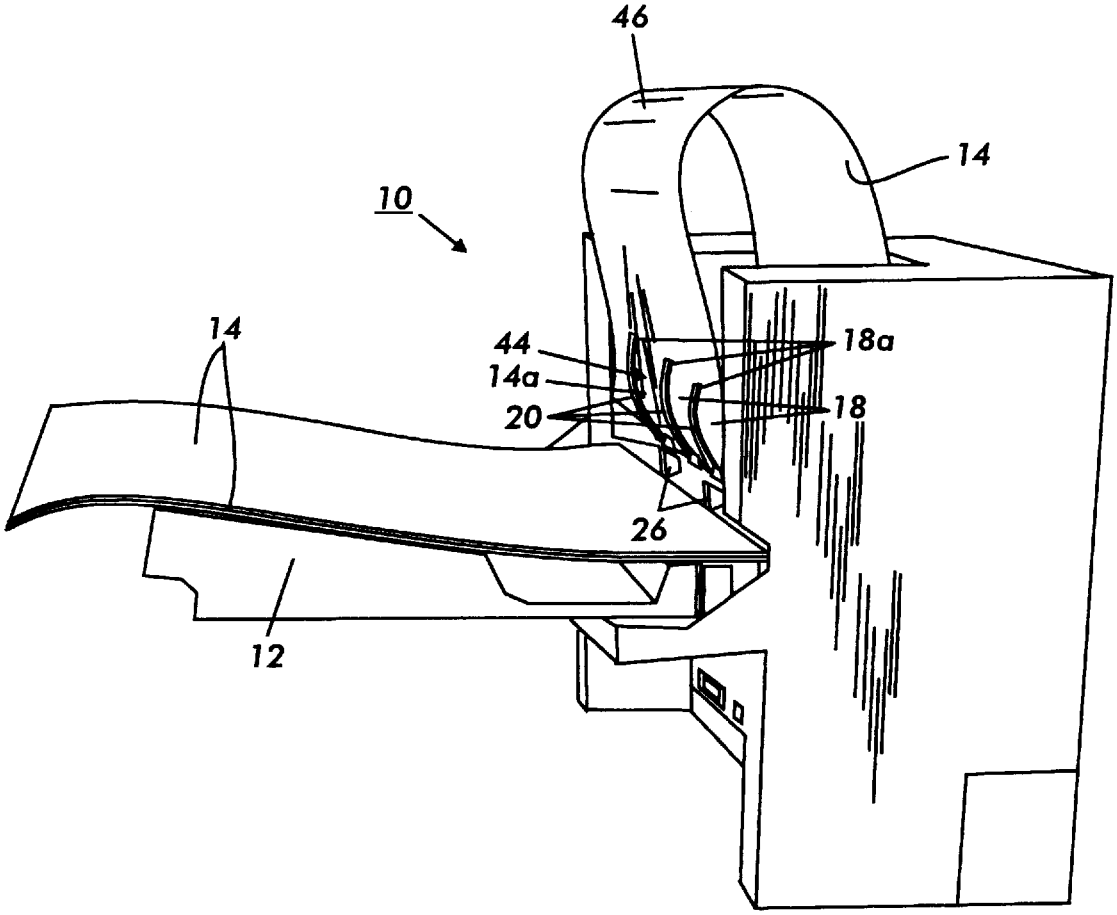

Disclosed in the embodiments herein is an improvement in the stacking of sheets in a disk type inverter-stacker, especially large and/or flimsy sheets.

The disclosed system is simple and of low cost, yet overcomes serious problems with the proper stacking of long limp or low beam-strength sheets, such as some large, thin and/or short grain paper copy sheets, in a disk-type inverter-stacker system. Such large and/or flimsy sheets can have stacking failures when the trail end area of the sheet collapses back over the preceding leading portion of the sheet in the output tray to form a loop thereon rather than rolling out fully onto the stacking tray to lay flat thereon. Such miss-stacking prevents the stacking of the subsequent sheets being outputted to the inverter-stacker from a printer or copier.

Further by way of background, in reproduction apparatus such as xerographic and other copiers and printers or multifunction machines, it is increasingly important to provide more automatic and reliable handling of the physical image bearing sheets. Especially for shared or networked printing systems in which the sheet printing and outputting may be unattended. In a typical well known disk-type inverter-stacker, as shown and described in the cited and other references, printed copy sheets are sequentially fed from the printer or copier (IOT) output into the sheet entrance of the disk-type inverter-stacker and/or finisher output unit. Typically in such disk-type output units, plural spaced semi-cylindrical disk fingers have or define sheet receiving slots. The entrances to these slots are normally initially positioned at the top of the output unit so that the lead edge of the next incoming sheet may be fed into these disk slots. The disk slots temporarily hold at least the leading edge area of the sheet within the slots for the sheet inversion. The disks, with these fingers, are rotated approximately 180 degrees, which rotates the lead edge of the sheet therein around to engage a registration edge under the disk unit for stripping the sheets out from the disk slots and stacking the (now inverted) sheet onto an associated output stacking tray.

This disk-type inverting and stacking system presupposes that the remainder of the sheet which does not fully fit into the disk finger slots will be flipped over to fall out flat on the stacking tray in this same rotational movement. However, as noted above, this may not always occur with a sufficiently lengthy and/or flimsy sheet of paper. The printer or copier, which has necessarily continued to feed the long sheet out even after the lead edge of this sheet has already been fed fully into the disk slots, to the end of the slots, can form a large loop of the trailing area portion of the large sheet which is now hanging down over the tray, as illustrated in the FIG. 3 example. When the lead edge of this sheet is released from the disk fingers, that loop should roll out slowly onto the tray. However, instead, it may, as illustrated in the stacking failure example of FIG. 4, cause the trail end area of the sheet to fall down directly onto the front of the stack instead. In that stacking failure mode the sheet forms a loop on top of the stack, rather than a laid out sheet. That is, the trail end of the large sheet collapses onto the upstream portion of the stack, onto the front portion of that same sheet, to cause a stacking failure, as shown.

The disclosed system overcomes the above and other stacking problems for such large and/or flimsy sheets. As disclosed in the embodiment hereinbelow, a simple special corrugation unit may be mounted to the disk stacking unit which can provide a long corrugation of the sheet in the process direction. That long corrugation and its consequent local beam strength increase causes the loop of the trailing portion of the sheet to form much higher up, i.e., to form a loop above the disk stacker, as shown in the example of FIG. 1, rather than down and out over the stack as in the example of FIG. 3 noted above. I.e., this corrugation unit causes a much more vertically oriented trailing end portion loop to form in the sheet, even for a flimsy sheet much longer than the disk slots in the process direction. It has been found that this corrugation unit thus causes the trailing end portion of the sheet to fall into the tray with significantly increased momentum from that much higher level, and about a larger effective radius, and that this increased momentum causes even very large and limp sheets to be much more successfully rolled out onto the output tray with proper stacking.

The disclosed system has been shown to be successful even in stacking large European A3 size short grain paper with 80% relative humidity, a particular problem in European copying and printing, or U.S. 11×17 size sheets being fed short edge first. Additionally, the sheet stacking registration or stack "squareness" (sheet skew reduction) is significantly improved for such large flimsy sheets with this disclosed special corrugation unit.

Output stacker modules with inverters, such as disk-type inverter-stackers, are well known per se and need not be described in detail herein. Examples include Xerox Corp. U.S. Pat. No. 5,409,202 issued Apr. 25, 1995 to Raymond A. Naramore and William E. Kramer (D/93678), and other art cited therein. Such inverter stackers are useful, for example, for accepting sheets from a printer printed face-up in forward or 1 to N serial page order for stacking those sheets face-down so as to provide properly collated output sets, i.e., sets in 1 to N order when picked up from the output tray. Or, for duplex printed sheets in which the second or even page sides are printed face down. The inverter-stacker may also be part of a system providing an automatically selectable output tray in a system also providing a non-inverting output stacking tray to provide a selection between face up or face down stacking for different printing modes and/or to avoid an internal printer inverter. An internal inverter may be harder to clear sheets from in the event of a machine jam than an easily externally accessible disk-type stacker unit. It will also be noted that in such disk-type inverter-stackers the fingers defining the sheet transporting slots can be either integral the outer edges of the rotating disks and define a slot therebetween, or pivotally mounted thereto and have slots defined within the fingers.

Likewise, the physics of sheet corrugation is known from other applications. One example of a large document re-stacking system with corrugation provided between exit rollers, without sheet inversion is in Xerox Corp. U.S. Pat. No. 4,469,319 issued Sep. 4, 1984 to F. J. Robb, et al. (D/82231). Of particular interest here as being in a disk stacker with sheet inversion is Xerox Corp. U.S. Pat. No. 5,261,655 issued Nov. 16, 1993 to Paul D. Keller et al entitled "Disk Stacker with Intermittent Corrugation Assistance for Small Sheets" (D/92653) (distinguishing emphasis supplied).

A specific feature of the specific embodiment disclosed herein is to provide a disk-type inverter-stacker system with plural rotatable fingers extending radially from an axis of rotation for sequentially inverting and stacking onto a stacking tray the printed sheets outputted by a reproduction apparatus by temporarily retaining at least the leading edge portion of the sheet in sheet transporting slots defined by inside surfaces of said rotatable fingers, the improvement comprising at least one sheet corrugating member spaced from but interdigitated with at least two of said plural rotatable fingers, said sheet corrugating member extending radially from said axis of rotation slightly radially beyond said inside surfaces of said rotatable fingers to slightly corrugate said leading edge portion of said sheet while said sheet is in said slots defined by said rotatable fingers to provide improved said inverting and stacking onto said stacking tray of sheets exceeding the length of said slots.

Further specific features disclosed herein, individually or in combination, include those wherein said sheet corrugating member is fixed in position and does not rotate with said rotatable fingers; and/or further including a fixed arcuate baffle radially inside of said rotatable fingers, and wherein said sheet corrugating member is mounted to said fixed arcuate baffle; and/or further including a fixed semi-cylindrical baffle radially inside of said rotatable fingers, and wherein said sheet corrugating member is a stationary arcuate narrow finger-like member mounted to and extending partially around said fixed arcuate baffle between two of said rotatable fingers but extending slightly radially outwardly of said inside surfaces of said two rotatable fingers; and/or wherein said sheet corrugating member causes said sheets exceeding the length of said slots to form a loop in said sheets extending above said inverter-stacker system.

In the description herein the term "sheet" refers to a usually flimsy physical sheet of paper, plastic, or other suitable physical substrate for images, whether precut or initially web fed and cut internally. A "copy sheet" may be abbreviated as a "copy", or called a "hardcopy". A "job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from cited art. All references cited in this specification, and their references, are incorporated by reference herein where appropriate for appropriate teachings of additional or alternative details, features, and/or technical background. What is well known to those skilled in the art need not be described here.

Figure 2:
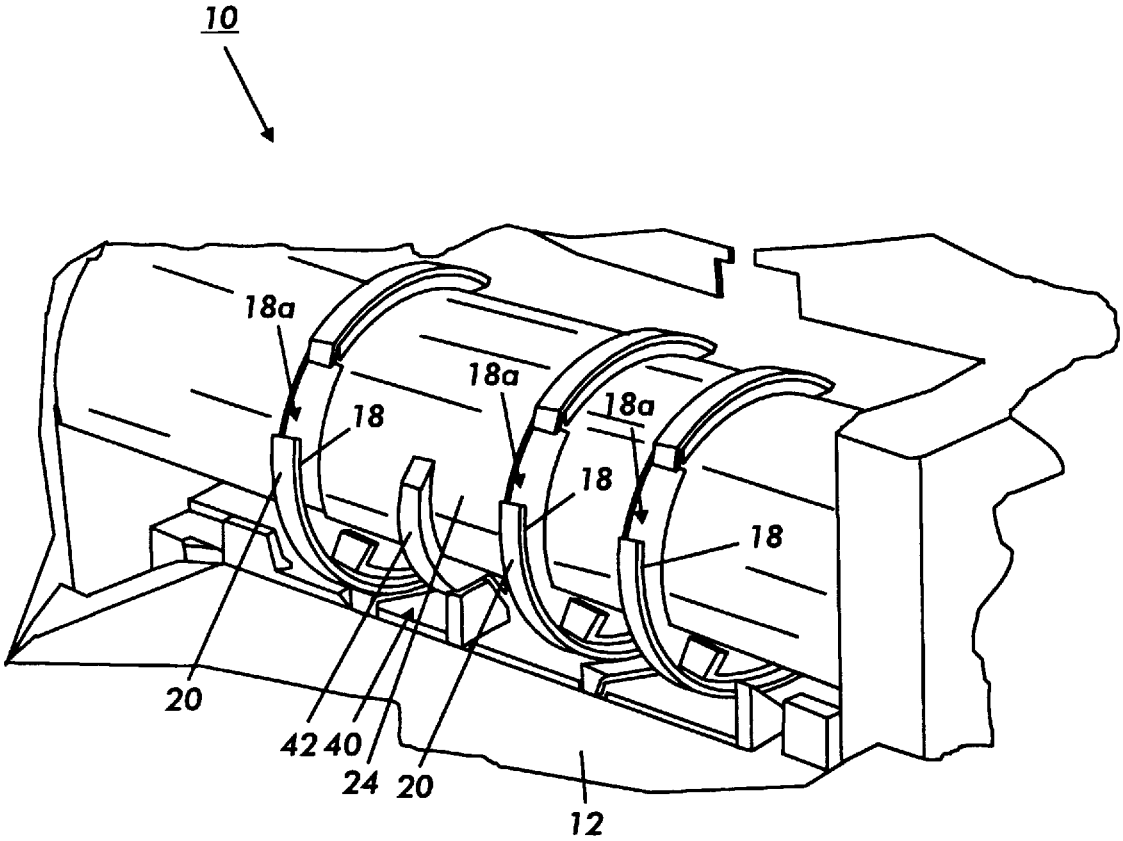
Figure 3:
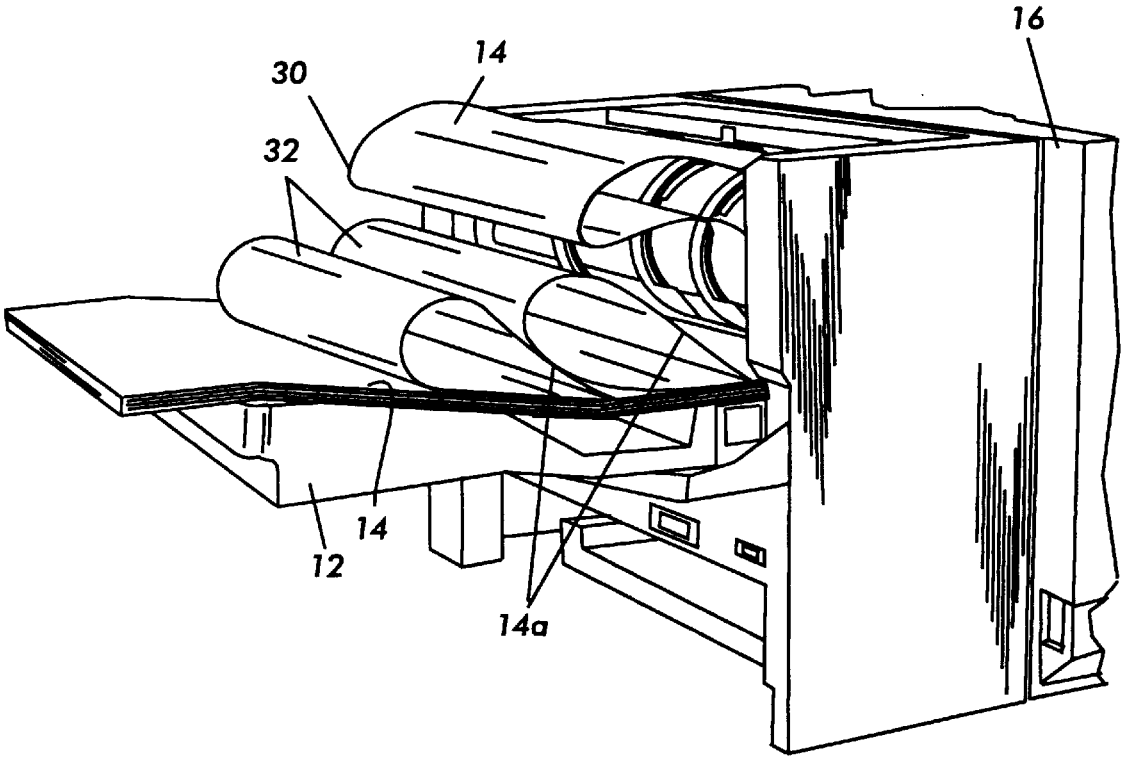
Figure 4:
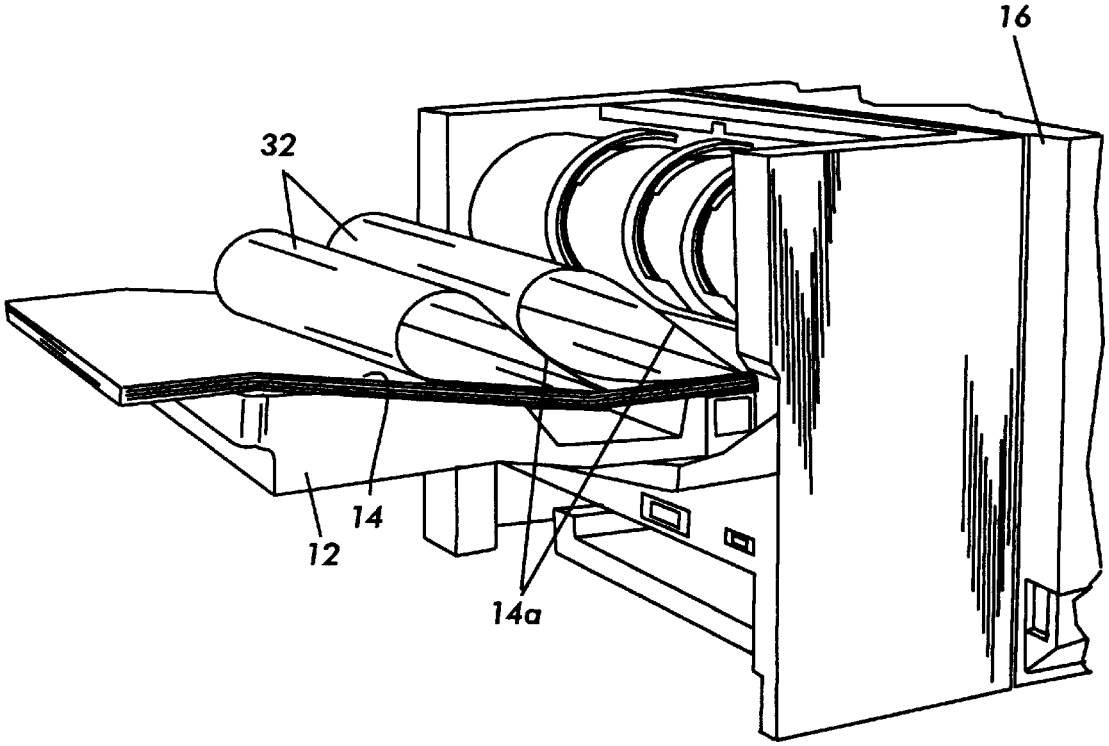
Figure 5:
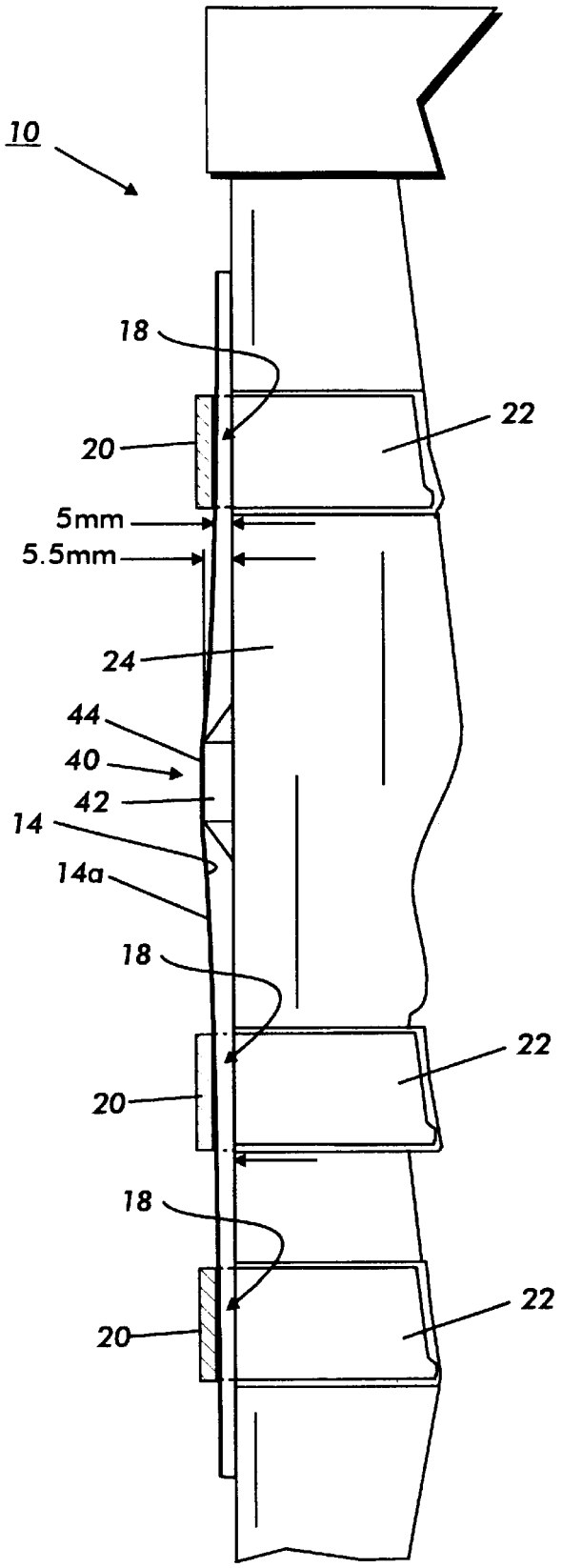

Various of the above-mentioned and further features and advantages will be apparent from the specific apparatus and its operation described in the example below, and also in the claims. Thus, the present invention will be better understood from this description of a specific embodiment, including the drawing figures (approximately to scale) wherein:

FIG. 1 is a perspective frontal view of one embodiment of the disclosed system, showing the improved higher loop formation by the subject corrugation unit in a large flimsy sheet about to be inverted and stacked in a disk-type inverter stacker unit like that shown in the above-cited U.S. Pat. No. 5,409,202;

FIG. 2 is an enlarged perspective view of the disk-type inverter stacker unit of FIG. 1, shown without any sheet present to illustrate the subject corrugation unit;

FIG. 3, labeled "Prior Art", shows in perspective in contrast to FIG. 1 the prior initial loop formed in the same large flimsy sheet about to be inverted and stacked in the same disk-type inverter stacker without the subject corrugation unit;

FIG. 4, also labeled "Prior Art", shows the miss-stacking failure which can result from the situation illustrated in FIG. 3 when that sheet is inverted and stacked in that unit; and FIG. 5 is a top or overhead cross-sectional enlarged partial view of the system of FIG. 1.

Describing now in further detail the exemplary embodiment with reference to the Figures, there is shown in all of the figures an otherwise known disk-type inverter stacker output module unit 10 like that shown in the above-cited U.S. Pat. No. 5,409,202 for inverting and stacking in a stacking tray 12 the sheets 14 sequentially outputted by a reproduction machine 16. The machine 16 is merely one example of any of various reproduction machines with which the present system may be utilized, such as a xerographic laser printer. The sheets 14 are inverted and stacked by the unit 10 as previously described above. The output unit 10 may also include jogging or tamping and stapling or other set finishing, as also described in that patent, if desired. Specifically, printed copy sheets 14 are sequentially fed from the printer or copier (IOT) 16 output into the sheet entrance of the disk-type inverter-stacker output unit 10, for feeding each sheet into sheet receiving slots 18 defined by plural spaced semi-cylindrical disk fingers 20 on rotatable disks 22 and a semi-cylindrical sheet baffle surface 24. The entrances 18*a* to these slots 18 are initially positioned at the top of the disk unit 10 so that the lead edge 14*a* of the next incoming sheet 14 may be fed fully into these disk slots 18. The disk slots 18 temporarily hold at least the leading edge area of the sheet 14 within the slots for the sheet inversion, which is accomplished by next automatically rotating the disks 22, including their fingers 20, approximately 180 degrees. This rotates the lead edge 14*a* of the sheet 14 therein around by that same amount, until the sheet lead edge engages a registration edge or fingers 26 under the disk unit 10, which strips the sheet out from the disk slots as the disks continue to rotate. The now substantially inverted sheet 14 thus is supposed to stack neatly onto the underlying output stacking tray 12.

However, as noted above, and shown in FIGS. 3 and 4, proper stacking does not always occur with a lengthy and/or flimsy sheet of paper 14. The printer or copier 16 continues to feed the remainder of the long sheet 14 out after the lead edge of this sheet has already been fed fully into the slots 18, to the ends 18*b* of the slots. As shown in FIG. 3, with the prior system, this forms a large loop 30 of the trailing area portion of the large sheet 14 which, due to its weak beam strength, hangs down in front of the disks 22 over the upstream portion of the tray 12. When the lead edge of this long flimsy sheet 14 is released from the disk fingers, that loop 30 may not unfold to flip over its trailing end 14*b* and roll out onto the tray 12, as it should. Instead, as illustrated in the stacking failure example of FIG. 4, the trail end 14*b* area of the sheet 14 may fall down directly onto the front or upstream area of the stacking tray 12. In that stacking failure mode the sheet 14 forms a loop 32 on top of the stack of prior sheets, rather than a laid out sheet, to cause a stacking failure, as shown.

Turning now to the disclosed specific example of a corrugation system solution to these and other problems, shown particularly in FIG. 2 is a corrugation unit 40. In this example, this is at least one elongated stationary corrugation finger member 42 stationarily mounted to the cylindrically shaped stationary baffle 24. Here, as shown, the corrugation member 42 is mounted laterally spaced between the two furthest spaced apart disk fingers 20 of the disk stacking unit 10. This corrugation member 42 here is smoothly rounded and has a smoothly tapered tip so as to prevent stubbing of the sheet 14 lead edge 14*a* as the sheet lead edge 14*a* is passed over this corrugation member 42 by the rotation of the disks during the above-described sheet inversion and stripping. This corrugation member 42 extends partially around the cylindrical baffle 24, extending from underneath (adjacent the registration edge 26) upwardly to approximately the midpoint of the height of the cylindrical baffle 24 in this example. This corrugation member 42 also extends outwardly from the cylindrical baffle surface by a defined radial distance. That radial distance is extending radially slightly beyond the inside surface 20*a* of the disk fingers 20 in which the sheet 14 is being carried and supported at that point. The corrugation member 42 here otherwise roughly parallels the disk fingers 20, and extends circumferentially by approximately the same distance as the disk fingers, and may be approximately the size of a disk finger. However, unlike a disk finger 20, the corrugation member 42 is not rotatably mounted, and, as noted, differently radially spaced. The corrugation member 42 is stationary, and its different radial spacing corrugates each sheet as the sheet is pulled down thereover by the sheet transporting movement of the disk fingers. For example, if the inside 20*a* of the disk fingers 20 are approximately 5 mm radially outward from the cylindrical baffle 24 outer surface, the outer surface of this corrugating member 42 is desirably extending about 5.5 mm therefrom, i.e., about 0.5 mm radially further out than the sheet slot defined by the disk fingers, i.e., extending outwardly from or beyond the inside of the disk fingers by approximately one-half millimeter. That is sufficient to slightly corrugate at 44 the sheet 14 by a considerable distance in the process direction at this critical position and time just before the sheet trail edge is released. That is, the corrugation 44 induced in the sheet 14 extends upstream in the sheet 14 well beyond the disk fingers and their slots to hold the sheet up. This results in the FIG. 1 illustrated much higher loop 46 formation, further upstream and vertically above the disks and disk fingers. Thus, as described above, upon release of the trailing edge 14*b* of the sheet, this much higher and better controlled loop 46 causes the trailing portion of the sheet 14 to much more vigorously flip over and out towards the outer end of the tray 12 with increased momentum and reduced foldover tendencies, so as to stack fully inverted flat out onto the tray 12, as desired.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a disk-type inverter-stacker system with plural rotatable fingers extending radially from an axis of rotation for sequentially inverting and stacking onto a stacking tray normal or larger size printed sheets outputted by a reproduction apparatus by temporarily retaining at least the leading edge portion of the sheet in sheet transporting slots of a defined length defined by inside surfaces of said rotatable fingers, the improvement comprising:

at least one sheet corrugating member spaced from but interdigitated with at least two of said plural rotatable fingers, said sheet corrugating member extending radially from said axis of rotation slightly radially beyond said inside surfaces of said rotatable fingers to slightly corrugate said leading edge portion of said sheet while said sheet is in said slots defined by said rotatable fingers to provide improved said inverting and stacking onto said stacking tray of larger size sheets exceeding said defined length of said slots;

wherein said sheet corrugating member is stationary and does not rotate with said rotatable fingers; and wherein said sheet corrugating member causes said larger size sheets exceeding the length of said slots to form an extended loop in said larger size sheets extending above said stacking tray.

2. The inverter-stacker system of claim 1 further including a stationary arcuate baffle radially inside of said rotatable fingers, and wherein said sheet corrugating member is mounted to said stationary arcuate baffle.

3. The inverter-stacker system of claim 1 further including a stationary semi-cylindrical baffle radially inside of said rotatable fingers, and wherein said sheet corrugating member is a stationary arcuate narrow finger-like member mounted to and extending partially around said stationary arcuate baffle between two of said rotatable fingers but extending slightly radially outwardly of said inside surfaces of said two rotatable fingers.

4. The inverter-stacker system of claim 1 wherein said sheet corrugating member causes said sheets exceeding the length of said slots to form a loop in said sheets extending above said inverter-stacker system.

* * * * *